United States Patent [19]

Voneiff

[11] Patent Number: 4,883,542

[45] Date of Patent: Nov. 28, 1989

[54] METHOD AND APPARATUS FOR CLEANING CONTAINERS

[76] Inventor: John Voneiff, 623-S. Caroline St., Baltimore, Md. 21231

[21] Appl. No.: 136,323

[22] Filed: Dec. 22, 1987

[51] Int. Cl.[4] ..... B08B 1/02

[52] U.S. Cl. ..... 134/21; 15/1.5 R; 15/306 B; 15/308

[58] Field of Search ..... 134/21; 15/306 B, 308, 15/306 R, 1.5 R

[56] References Cited

U.S. PATENT DOCUMENTS

| | | | |
|---|---|---|---|
| 3,128,492 | 4/1964 | Hanscom et al. | 15/308 |
| 3,395,042 | 7/1968 | Herbert | 15/308 X |
| 3,668,008 | 6/1972 | Severynse | 15/306 AX |
| 4,304,026 | 12/1981 | Borostyan | 15/308 |
| 4,701,973 | 10/1987 | McBrady et al. | 15/306 B |
| 4,727,614 | 3/1988 | Swistun | 15/306 BX |

*Primary Examiner*—Chris K. Moore

*Attorney, Agent, or Firm*—Kenyon & Kenyon

[57] ABSTRACT

The disclosure relates to a method and apparatus for cleaning container bodies. The containers are moved through a station where they are subjected to a neutralized atmosphere created by directing ionized atmosphere over the container bodies as they move through the station. The bodies are also subjected to wiping action of brushes to remove particulate material therefrom. A vacuum system is employed to completely remove the particulate material from the atmosphere.

2 Claims, 3 Drawing Sheets

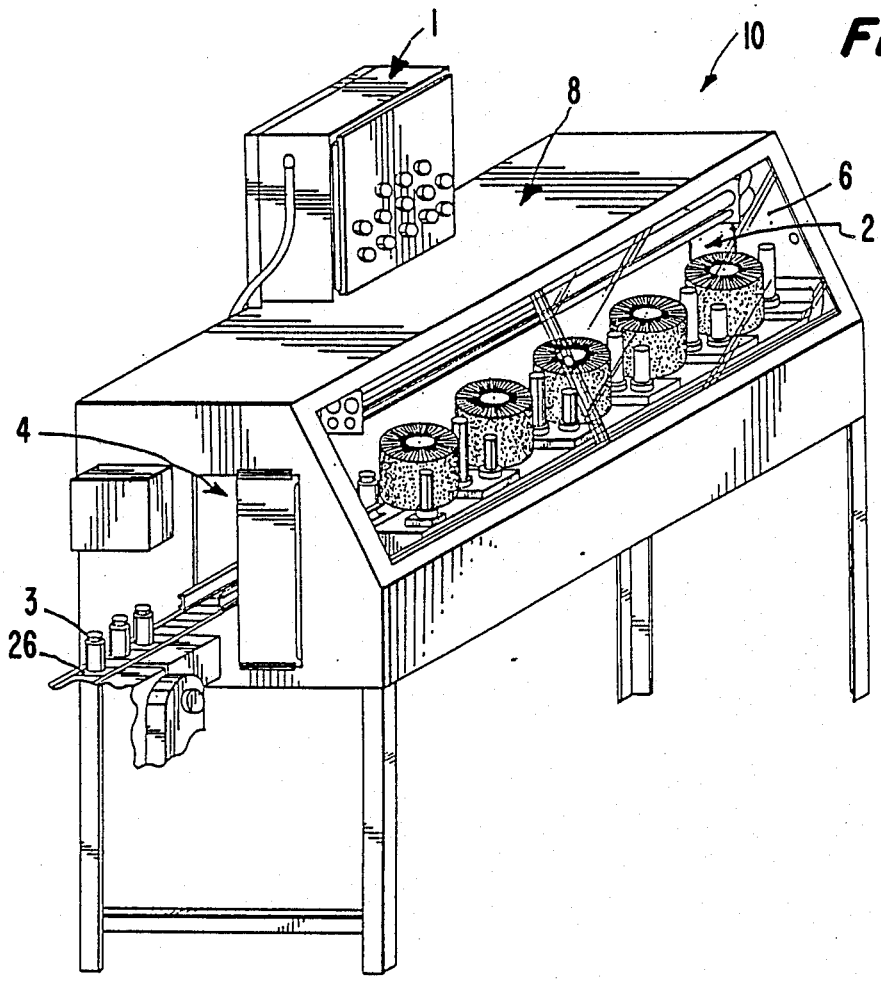
FIG. 1.
FIG. 2.
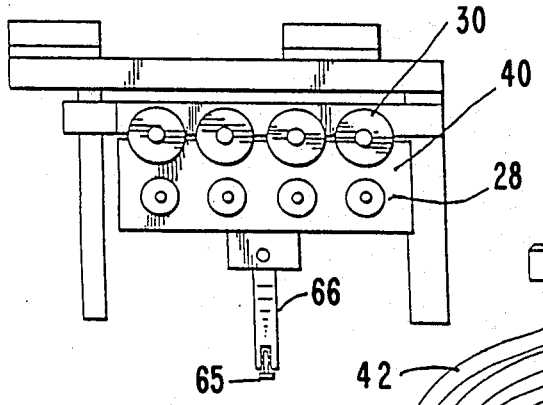
FIG. 9.
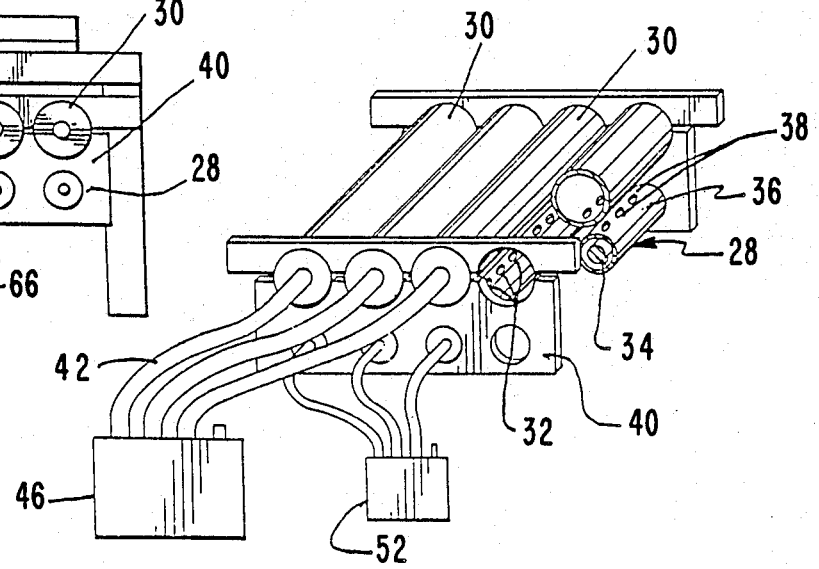

METHOD AND APPARATUS FOR CLEANING CONTAINERS

BACKGROUND AND DISCUSSION OF THE INVENTION:

In certain types of manufacturing facilities, particularly those involving particulate products, it is necessary to fill the containers with the products prior to the labeling procedure. As a result of this sequence, it is often difficult, particularly in a continuous process, to sufficiently clean the container for accommodating a gummed label, or other type of labeling, involving an adhesive. Because of the nature of the product, the particulate material tends to adhere to the exterior surfaces of the container. The accumulation of this material can be to such an extent that it interferes with the adhesive action between the container surface and the label. In production facilities involving this type of packaging, efforts have been made to clean the surface of the container and eliminate the impediment between the adhesive on the label and the clean surface of the container. Otherwise, the label may eventually peel off partially or entirely creating an unseemly and unacceptable product to the ultimate consumer.

Methods and apparatus for attempting to remove particulate matter have included rotary brushes in conjunction with moving air through the environment where the cleaning operation occurs. Often these brushes are tightly packed, relatively stiff bristle devices rotating at relatively high rates of speed. As a result, substantial friction may occur as the brushes engage the container as well as turbulence and dispersion of the particulate material throughout the environment even if it were removed from the container. Blowing air across the container similarly disperses the particulate material throughout the atmosphere and, may not necessarily be productive in removing the particulate material in the vicinity of the container.

Particulate removal operation such as that described above, has not been completely productive. Rather, a certain amount of particulate remains in the environment and on the container hindering the application of the labels. Applicant's invention has overcome many of the problems discussed above. The invention described herein utilizes a vacuum system in conjunction with relatively slow moving soft bristle brushes to effect a wiping action. In addition, an ionizing air flow is utilized to create a neutral environment. The cooperation of these elements produces an environment where substantially all of the particulate matter on the surface of the container can be removed to create a surface which will readily accommodate the label without the problems discussed above.

The invention removes dry product residue from the outside surface of containers after they have been filled and as they move along a continuous path for subsequent labeling, and other cartoning functions. In this system, a high force low volume vacuum, in conjunction with the rotary brushes are utilized as the containers move along a straight path past the brushes for wiping action of the surface of which is to be cleaned and/or labeled.

To achieve the proper cleaning conditions, there are a number of basic functions which are accomplished, including the maintenance of the container in a controlled manner for proper action by the brushes and other elements of the controlled environment; controlling the static electricity within the cleaning environment; disturbing the bond between product particles and the container wall surface within an electrically neutralized environment and removing the collected products from the wiping brushes and from the container surfaces.

To insure that each container is operated on in a controlled manner, each is removed from a plurality containers in controlled manner, moved past the brushes at a predetermined rate of speed, and positioned for proper wiping motion by the brushes. This is accomplished in the invention through a timing screw and adjustable guide. The timing screw in cooperation with the guide, engages the container and moves it past a series of brushes at the requisite rate of speed. The containers are engaged by other elements of the apparatus and moved by the screw such that they constantly rotate as they are moved past the brushes. This facilitates the entire container being wiped free of the particulate matter.

Particularly containers made from synthetic materials as they travel along a continuous path develop static charges. The particulate matter used in filling each container also develops such charges resulting in an attraction between themselves and the surface of the container. The invention described herein, to facilitate removal of the particulate matter, creates electrically neutral environment in the vicinity of the containers. An ion atmosphere is created to providing a source of ions of either charge which can neutralize the container, the product particles, the conveyor, and all the other elements within the cleaning environment. A source of air at a relatively low volume and velocity rate provides a relatively constant flow of ionized air over the containers and other elements of the apparatus in the environment where the cleaning operation takes place.

The creation of the neutral atmosphere in and of itself, may not be sufficient to cause the particles to remove themselves from the surface of the container. A physical force is utilized in conjunction with this environment to remove particles remaining on the surface of the container even though the electrical bonds have been neutralized. Wiping brushes arranged in series adjacent to the continuous path of the containers engage the containers of the container walls traps and collects a high percentage of the particulate matter. Other particles which are not collected by the brushes fall into areas of the conveyor machine where they will not interact with the passing containers but can be removed at a later time.

In addition to the functions discussed above, there is provided a system to continuously and permanently remove the collected particles from the cleaning environment. A high suction force low volume vacuum cleaning system is directed through a vacuum manifold and an adjustable vacuum tube to remove the particulate matter from the brushes and other areas of the environment. The openings, or inlets, through the tubes to the vacuum manifold are located in close proximity to the brushes but at a position, remote from that of the containers. This reduces turbulence and enhances removal of the particulate matter from the cleaning environment.

The above has been a brief discussion of some deficiencies in the prior art and advantages of the invention. Additional advantages will be readily perceived from the detailed discussion of the preferred embodiment which follows.

BRIEF DESCRIPTION OF THE DRAWINGS:

FIG. 1 is a perspective view of the apparatus utilized in cleaning containers.

FIG. 2 is an end view of a portion of the apparatus for supporting air tubes and ion bars.

DETAILED DESCRIPTION OF THE PREFERRED EMBODIMENT

Figure 3:
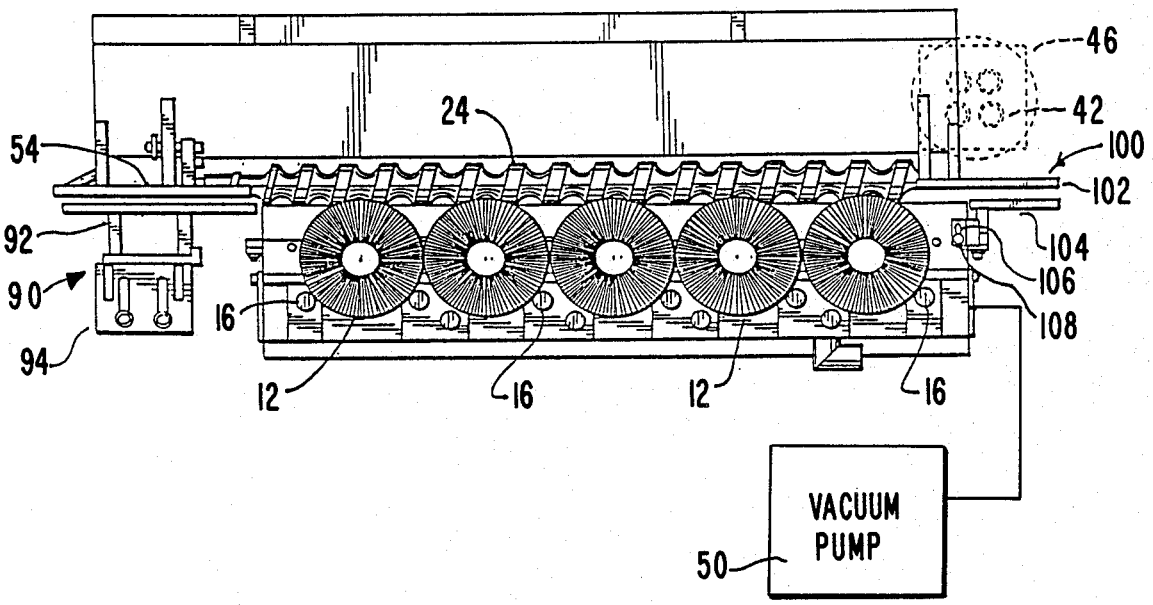
FIG. 3 is a plan view of the portion of the apparatus showing the brushes and the screw for moving the containers.
Figure 5:
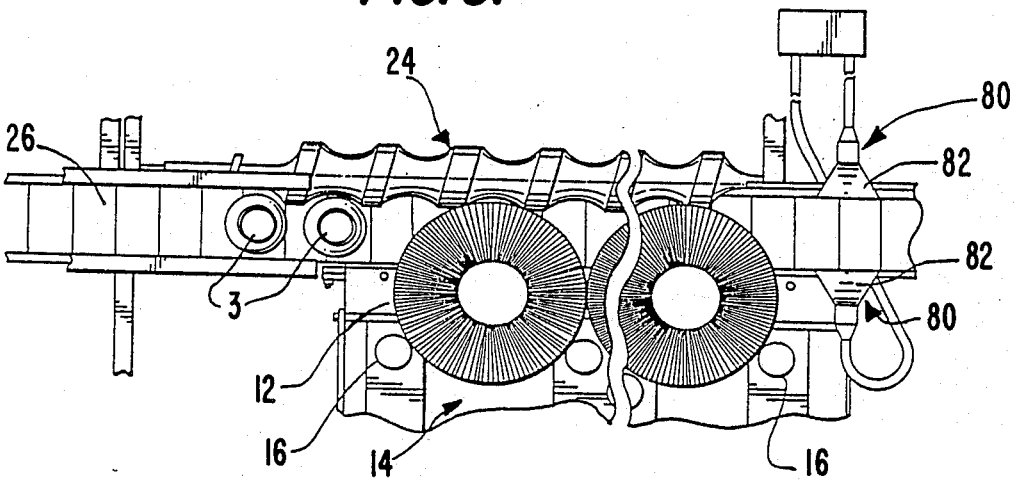
FIG. 5 is an enlarged view of a portion of the apparatus shown in FIG. 3.
Figure 7:
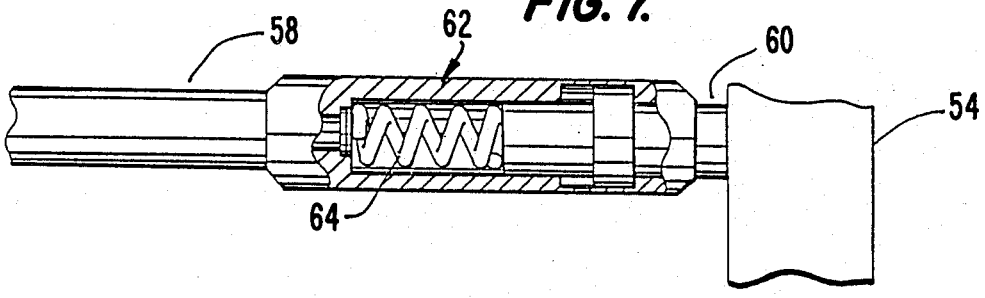
FIG. 7 is an enlarged view of the apparatus shown in FIG. 6 with a portion cut away.
Figure 6:
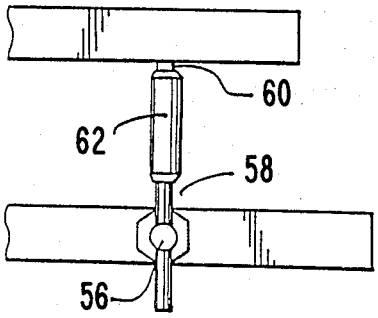
FIG. 6 is an enlarged view of a portion of the apparatus as shown in FIG. 3.
Figure 8:
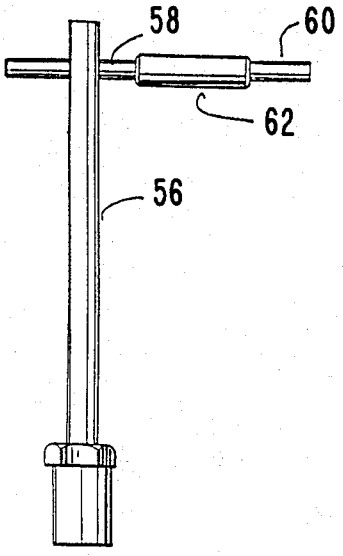
FIG. 8 is a side view of the apparatus shown in FIG. 6.

As can be seen in FIG. 1 there is shown in perspective a station for utilizing the method and apparatus of the invention. Station 10 includes a metal housing 8, having a movable glass front 6 for viewing the operation of the apparatus and entrance port 4 and exit port 2 for containers 3 which are subjected to the cleaning operation at the station between these parts. On top of station 10, is a control panel 1 which includes control means for varying speeds of the conveyor belt, brushes, vacuum, etc., all adjustable according to the operation desired. As can be seen in FIGS. 1 and 3, five brushes 12 are arranged on a plenum chamber 14 for rotational movement. Brushes 12 are arranged with respect to conveyor belt 26 and timing screw 24 to engage the containers as they are moved down the conveyor belt by timing screw 24 to wipe off any particular material which may remain on the containers. Brushes 12 are arranged such that the axis of rotation for each is equally spaced from and adjacent, and each brush 24 has the same diameter. As shown, particularly in FIG. 3 and FIG. 5, the brushes are such a diameter that they are adjacent to one another but do not engage bristles of a adjacent brush during operation.

At a position somewhat remote from the conveyor, primary vacuum tubes 16 are arranged adjacent to the brushes 24. As can be seen in more clearly in FIG. 4, these primary tubes 16 have an elongated configuration extending vertically from plenum chamber with a vertical inlet slot 20 which extends substantially the entire length of the brush. Each of these primary tubes 16 communicates to the interior of the plenum chamber 14 which is in turn connected to a vacuum pump 50 (shown in schematic) which draws a significant vacuum on the plenum chamber. The vacuum developed in the chamber 14, and ultimately through the tubes 18, cooperates with the slot 20 to impose a strong vacuum in a very narrow band in the vicinity of the brush somewhat remote from other conveyor paths. As the brush rotates and wipes material off the bottles or containers 3, at the position remote from container 3, the vacuum draws material off the brush and through slot 20 into tube 18, it will be sucked into the plenum and ultimately into the vacuum pump 50.

It should be noticed that there are also arranged a series of secondary vacuum tubes 18 adjacent to primary vacuum tubes 16. The secondary vacuum tubes are the height somewhat less than height of primary vacuum tubes but otherwise arranged similarly to tubes 18 for communication with the brushes 12 through a secondary slot 22 and an outlet communicating with the plenum chamber 14. The secondary vacuum tubes 16 cooperate with smaller brushes not shown. Where smaller bottles are utilized such that the width of the larger brushes that are shown are not required, the vacuum tubes in conjunction with the plenum 14 cannot be efficiently utilized as a portion of the slot would extend beyond the width of the brush. Accordingly, these vacuum tubes 16 can be closed on the plenum chamber when smaller brushes are used and a secondary tube 18 open to provide the requisite that vacuum to remove the particulate matter from the brush.

Figure 4:
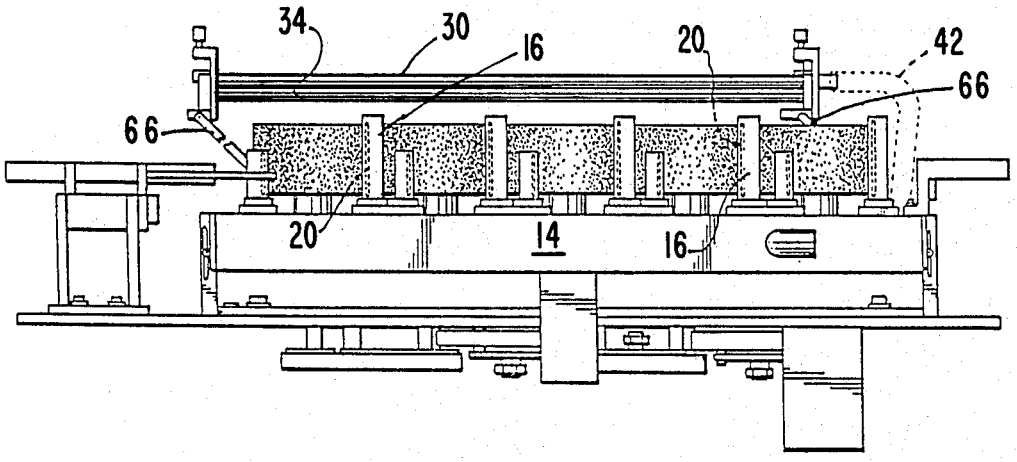
FIG. 4 is a front view of the apparatus shown in FIG. 3.

As can be seen in FIG. 4, air tubes 30 are arranged in parallel relationship above ion rods 34. As can be seen in FIG. 9 in the preferred embodiment four such air tubes 30 are arranged between brackets 40, 41. Each tube has a series of holes 32 arranged along the portion of the tube facing the ion rods 28. One end of each tube 30 has an inlet at 45 connected to an air chamber 46 through flexible hose 42. Chamber 46 includes a pump apparatus for pumping air through the flexible hoses 42 into the air tubes 30. The air is then emitted through the holes 32 to flow over the ion rods 28 as will be described later herein.

The ion rods 28 each include an outer housing 36 having holes in its upper and lower portion 38 with ion core 34 extending in the center of the tube 36. The holes 38 permit the air being emitted from the air tubes 30 to flow into the annular area around the core 34 and then out of the tubes through corresponding holes 38 in the bottom portion of the tube. The core 34 itself is connected to an electric source through cables 51, as can be seen in FIG. 9. When placed in operative position the electric source of 52 generates a potential to cause the ion core to emit ions.

In operation the air from chamber 46 is forced through the hoses 42 into the tubes 30 and out through the holes 32 into holes 38 of the ion rods 28, over the core 32 and out of the holes 38 in the lower portion of the ion rods 28. In this manner, an air curtain or air flow from the tubes 30 picks up ions by flowing over the rods and through the core member 38 and washes the containers moving beneath the ion rods 28 on conveyor belt 26 to create an essentially ion free atmosphere. In this manner, there is provided an infinite source of ions which electrically neutralizes the cleaning environment.

As the containers move along the conveyor path and through station 10 they may develop static charges which can accumulate to several thousand volts. These static charges will attract contamination. The ionized air curtain flowing over the containers in the station as mentioned contains positive and negative charges that become an infinite source of ions of either charge to neutralize the container, product particles, conveyor, wiping brushes and everything else within the cleaning environment. This ensures that little or no charge in the environment maintains the attraction between contaminate material and the containers. As a result the brushes can readily wipe the materials from the containers as they move past a series of brushes located adjacent the conveyor belt.

A mechanism is provided to maintain the containers in the proper disposition relative to the brushes as the containers are continuously moved through the station. Guide bar 54 is configured to maintain sufficient pressure on the containers to ensure that they are properly engaged by a screw 34. Guide bar 54 includes a vertical rod 56 and a horizontal rod 58 having a tip 60 which is biased into an engagement position with the containers. The biased portion 60 includes a core 62 and a spring 64 for biasing the tip in the desired disposition. As a result when the container comes from the conveyor belt and enters the path defined by the fixed rod and biased tip 60 it will be maintained in the proper disposition as it is moved by the conveyor belt.

Horizontal bar 65 is adjustable through linkage 66 to adjust the position of the horizontal bar with respect to the height of the bottles. The horizontal bar engages the top portion of the bottle sufficiently during movement of the bottle by the screw 64 along the conveyor belt path to ensure that the bottle rotates about its own axis. This ensures that every portion of the bottle is wiped by the brush. Linkage 66 permits the horizontal bar 65 to be adjusted to the particular height of a bottle that is chosen.

At exit end of the station there is also provided suction members 80 for cleaning the portion of the conveyor belt which may have any contaminant on it from the wiping process. Suction members are 82 include opposed funnels 82 each connected by its corresponding hose 84 to a plenum chamber 86. This plenum chamber is subjected to the same vacuum source as is plenum chamber 14. A vacuum in the vicinity of the conveyor belt at the exit portion of the station is subjected to a vacuum to withdraw any contaminant in the vicinity. As a result bottles or containers 3 leaving the station 10 are substantially contaminant free and are ready for labeling process.

It should also be noted that the apparatus includes a number of adjustment features which enhances used with various types and configurations of bottles or other containers. For example, guide bar a bracket assembly 90 has an opposed portion 92 which is fixed to an adjustable track 94. Opposed portion 92 as can be seen better in FIG. 4 has adjusting slots provided as a means for adjusting the position of the bracket through bolts to the lower fixed portion of the station. As a result, the position the guide bar can be adjusted to accommodate particular bottles. Similarly exit brackets 100 have two opposed members 102 and 104. Member 104 is adjustable through slot 106 and bolt 108. By conventional operation of the bolt with respect to the slot the position of the bracket can be adjusted to accommodate various sized bottles other adjustment mechanisms which are shown include the ability to adjust the station with respect to the conveyor belt such that it can be assured that the station has the proper disposition in the vertical direction with respect to the conveyor belt. In addition, depending on the size bottles used a different screw may be used to accommodate different size bottles. As a result of this adjustability the versatility of the apparatus is enhanced to locate the apparatus with respect to a conveyor system in a given manufacturing facility and an adjustment to different container configurations. This makes the apparatus adaptable to different manufacturing environments.

In operation, once all the adjustments have been made and a screw chosen, bottles are moved on the conveyor belt to the guide bar assembly. The guide bar engages the bottle and fixes its position for engagement by the screw 34. The screw then separates the bottles as they are moved by the conveyor. Horizontal bar 65 engages the top portion of the bottle sufficiently to cause it to rotate as it passes brushes 12. Air flows over the ion bar and washes the bottles 3 to neutralize the entire atmosphere eliminating substantially any static charges between the contaminants in the bottles. As the bottles are moved through by the conveyor and constantly washed by the ionized gases, brushes 12 wipe the contaminants off the bottles 3 as they are rotated. The contaminant material that is picked-up by the brushes is drawn away by the vacuum tubes 16. As the bottles complete the wiping operation they engage exit guide assembly to ensure that the bottles are in the proper disposition for the next step which may be the application of the label. In the same vicinity of the exit guide assembly there is a vacuum suction assembly 80 which withdraws any contaminate material that may be on the conveyor belt itself. This ensures that the bottles and the conveyor are substantially contaminant free and avoiding the possibility of contaminant being replaced on the containers before the labeling step occurs.

What is claimed:

1. A method for cleaning particulate matter from container bodies comprising:

(a) moving the container bodies through a station;

(b) subjecting said containers to an ionization atmosphere while moving through said station;

(c) wiping particulate matter from said container bodies within said station;

(d) subjecting said wiping element to a vacuum for removing particulate material therefrom;

(e) said step of subjecting said container bodies to an ionization atmosphere including moving ionized air over said containers while moving through said station;

(f) the step of moving ionized air over said container bodies including moving said air during and after said wiping step;

(g) said wiping step including arranging a series of brushes along a linear path, and rotating said brushes about a fixed axis of rotation, and said container bodies being maintained in a path for movement adjacent to said brushes for engagement thereby to wipe a particulate matter therefrom;

(h) said step of subjecting said wiping element to a vacuum including applying the vacuum at a position on a rotating brush remote from a path of movement from said container bodies;

(i) said vacuum being applied along a narrow band substantially the entire width of each brush;

(j) a series of brushes being arranged in a line parallel to the path of said container bodies, and each brush being subjected to an independent vacuum band to remove the particulate matter therefrom;

(k) the step of moving said container bodies through the station including arranging a series of bottles in spaced relationship while in the station such that each bottle moves at a fixed rate past the brushes and at a fixed relationship between adjacent bodies;

(l) said step of moving ionized air including passing air over ion bars to ionize the air prior to passing the air over said bottles as they move through the station; and (m) said ionized bars being located in a position above the path of movement of said bottles and air being moved from a position above the bar such that it flows over the bars to be ionized and then passes over the bottles as they move along the fixed path.

2. An apparatus for cleaning container bodies comprising:

(a) a housing;

(b) a conveyor for moving said container bodies through said housing;

(c) means for substantially neutralizing the atmosphere within the housing in the vicinity of the container bodies as the containers are moved therethrough;

(d) wiping means arranged in the housing adjacent the conveyor for wiping particulate material from said container bodies;

(e) a vacuum means for removing particulate material away from said container;

(f) said wiping means including a brush;

(g) said vacuum means including a tube having an inlet and an outlet, said tube being located adjacent said brushes for removing particulate material therefrom via said inlet, said outlet being connected to a vacuum source;

(h) a plenum chamber being connected intermediate said tube in said vacuum source, said vacuum tube inlet having an elongated slot adjacent the periphery of said brush and an outlet connected to said plenum chamber;

(i) said vacuum source including a vacuum pump connected to said plenum chamber for drawing a vacuum on said chamber sufficient to effect removal of particulate material from said brush;

(j) means for separating said container bodies and maintaining separation as said container bodies are moved through the housing;

(k) said means for separating said container bodies and maintaining separation including a rotary screw having a thread for engaging a container delivered by the conveyor and maintaining a preselected distance between subsequent container bodies delivered to said screw;

(l) said means for neutralizing the atmosphere within the housing including an ionization means for producing ions in sufficient quantity to deionize particulate matter on said container bodies;

(m) said ionization means including an ion bar for producing ions arranged above said conveyor, a source of air for producing an air flow sufficient to pass over said ion bars, entrain ions, and pass over said container bodies to neutralize the atmosphere in the vicinity of said container bodies; and (n) at least two ion bars being located above said conveyor, said source of air including at least one tube arranged above said ion bars, said tube having outlets for delivering air over said ion bars at a flow rate to minimize turbulence within the housing.

* * * * *